United States Patent [19]

Emori

[11] Patent Number: 4,914,485

[45] Date of Patent: Apr. 3, 1990

[54] IMAGE FORMING APPARATUS

[75] Inventor: Kiyoshi Emori, Osaka, Japan

[73] Assignee: Minolta Camera Kabushiki Kaisha, Osaka, Japan

[21] Appl. No.: 372,140

[22] Filed: Jun. 26, 1989

Related U.S. Application Data

[63] Continuation of Ser. No. 236,934, Aug. 26, 1988, abandoned.

[30] Foreign Application Priority Data

Aug. 28, 1987 [JP] Japan ..... 62-216144
Aug. 28, 1987 [JP] Japan ..... 62-216115

[51] Int. Cl.[4] ..... G03G 15/00

[52] U.S. Cl. ..... 355/313; 355/316; 355/244; 271/288

[58] Field of Search ..... 355/313, 316, 309, 40, 355/50, 51, 244; 271/265, 266, 264, 288, 294, 298

[56] References Cited

U.S. PATENT DOCUMENTS 4,175,851 11/1979 Kitmura et al. ..... 355/14 R
4,702,589 10/1987 Ito ..... 355/14 SH
4,711,550 12/1987 Sumida et al. ..... 355/3 SH
4,712,908 12/1987 Nakayama et al. ..... 355/14 SH
4,723,148 2/1988 Hamakawa ..... 355/14 SH
4,743,945 5/1988 Ito et al. ..... 355/14 SH
4,745,439 5/1988 Hanada et al. ..... 355/14 SH
4,755,855 7/1988 Watanabe ..... 355/14 SH
4,772,917 9/1988 Tani ..... 355/14 SH

*Primary Examiner*—R. L. Moses
*Attorney, Agent, or Firm*—Burns, Doane, Swecker & Mathis

[57] ABSTRACT

An image forming apparatus provided with a control circuit for controlling movement of register rollers disposed on a sheet transport path extending to an image transfer section positioned around a photoconductive drum and also controlling the timing of image exposure to the photoconductive drum. The apparatus is equipped with a mechanism for detecting correlative positional error between a sheet and an image when first image formation is made in the composite image formation in which the same sheet of paper is repeatedly fed to the image transfer position.

The control circuit is arranged not to stop the register rollers when a sheet is fed to the transfer position on the second image formation, and exposure timing is set corresponding to an error detected by the detecting mechanism thereby registering the images formed on the second image formation corresponding to the image formed at the first image formation irrespective of any dislocation between the sheet and the image. The registering is carried out on each sheet of paper when it is required.

9 Claims, 15 Drawing Sheets

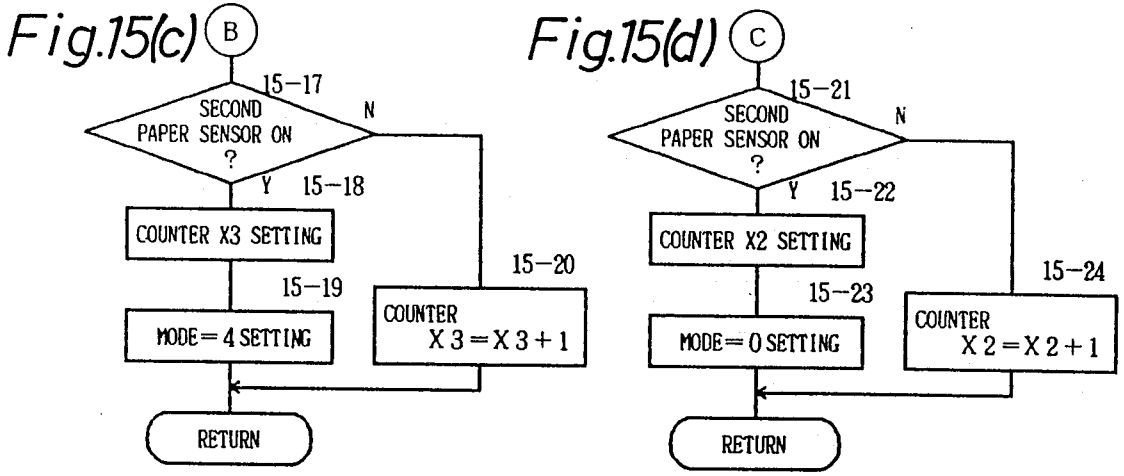
Fig.15(c)
Fig.15(d)
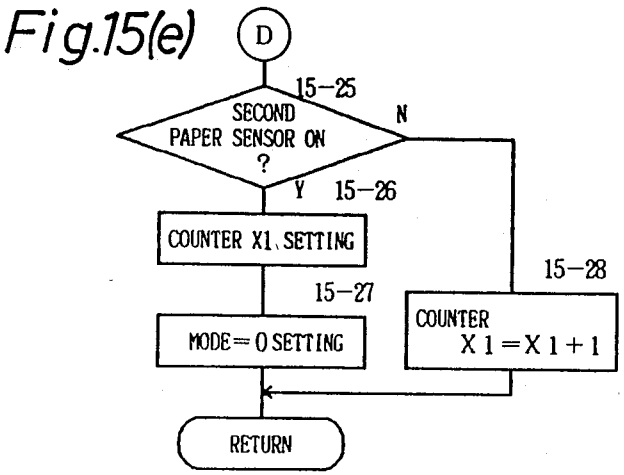
Fig.15(e)

IMAGE FORMING APPARATUS

This application is a continuation, of application Ser. No. 07/236,934, filed Aug. 26, 1988 now abandoned.

BACKGROUND OF THE INVENTION

1. Technical Field of the Invention

The present invention relates to an image forming apparatus for use in an electrophotographic copying machine, printer and the like and more particularly to an image forming apparatus which is arranged to prevent dislocations of images being formed by a series of image formations when composite image forming operation is carried out by repeatedly forming images on the same sheet of paper.

2. Brief Description of the Prior Art

Ordinarily, in an image forming apparatus, the timing for turning on register rollers provided for feeding a paper to a transfer section and the timing for starting exposure for an image onto a photoconductive drum are predetermined so as to always maintain a predetermined correlative relation between the front end of the copy paper being transported to a transfer section located around the photoconductive drum and the position of the image to be transferred on the photoconductive drum. Accordingly, accurate composite image formation must be carried out without having any dislocation of images on the transfer sheet even if plural image forming operations are repeatedly done on the same sheet of paper in composite image formation.

In actuality, however, such dislocations occur. Practically, the movement of a paper can not be made precisely as designed due to the scattering conditions such as the time in starting and stopping register rollers, the difference in each machine, the period each machine was used, and as a result, the front end of a paper and the position of an image on the photoconductive drum cannot correlate each other as predetermined.

A composite image forming procedure will be described with reference to FIG. 3 as an example. At the first image formation, a paper is fed from one of the paper feed rollers 4*a*–4*c* to transfer section 10 through register rollers 6, however, on and after the second image formation, the paper travels to the register rollers 6 through paper re-feeding path 14 and paper re-feeding rollers 8 as in the case when a paper is fed from the paper feed rollers 4*c*. Accordingly, traveling path of a paper which is fed from the paper feed rollers 4*a* and 4*b* to the register rollers 6 for the first image formation and the traveling path of the paper which is again fed to the register rollers 6 on and after second image formation differs thereby causing considerable difference in angle of the paper getting into the register rollers 6. Consequently, the position of the front end of each paper which, stops on the register rollers is subjected to be dislocated as shown in FIG. 4 (*a*) and (*b*), and there occurs dislocation between the image $I_1$ being formed at the first image formation and the image $I_2$ which is going to be formed on and after second image formation.

U.S. Pat. No. 4,175,851 discloses a device which is designed to avoid any positional disagreement between the front end of paper at the transfer section and an image on a photoconductive drum. The device includes a time measuring means for measuring an optionally predetermined time after standard signal has emitted for turning on register rollers or for starting exposure For starting exposure or turning on the register rollers by the output of the time measuring means based on the standard signal, it is arranged to correlate the front end of the paper at the transfer section with the position of the image on the photoconductive drum by adjusting the value set in the time measuring means. However, with such mechanism of device, it can not be effectively dealt with dislocations of front end of paper which occur in the first image formation and on and after second image formation. In order to deal with the dislocations, it may be considered to eliminate the temporary suspension of a copy paper at the position of register rollers on and after, second image formation. However, in such case, it is feared that the dislocation may occur in a composite image formation arising from the dislocations of positions of front end of paper at the position of register rollers when first image formation is carried out. The same problems lie in the device which sequentially form composite images by storing a plurality of copy papers in the paper cycling path for paper re-feeding.

SUMMARY OF THE INVENTION

The object of the present invention is, in consideration of the problems described above, to provide an image forming apparatus which is arranged to prevent dislocation of images being formed by a series of image formation when composite image forming operation is carried out in which images are repeatedly formed on the same sheet of paper.

Further object of the present invention is to provide an image forming apparatus capable of decreasing dislocations of composite images which occurs on the same sheet of paper by feeding back a correlative positional error between a paper and an image in the first image formation to on and after second image formation. The device is provided with a means for detecting correlative positional error between a paper and an image in the first image formation and a control means for setting an exposure timing according to the error detected while feeding a copy paper to a transfer section without suspending the paper at the position of register rollers on and after second image formation so that there is no influence arising from the difference in angle of the paper when getting into the register rollers in the first and second image formation.

Still further object of the present invention is to provide an image forming apparatus which is designed to prevent dislocations of images in composite image formation even if the quality of a plurality of copy papers and paper feeding trays are changed. The device is provided with a means for detecting correlative positional error between a paper and an image in the first image formation and a control means for setting an exposure timing according to the error detected on each sheet of paper while feeding a copy paper to a transfer section without suspending each sheet of paper at the position of register rollers on and after second image formation so that there is no influence arising from the difference in angle of the paper when getting into the register rollers in the first and second image formation. The device is further arranged to detect correlative positional error of each paper between the paper and the image in the first image formation, and capable of decreasing the dislocation of composite images of each copy paper by successively forming images for a plurality of papers by feeding back the error on each paper to on and after second image formation.

Further objects and features of the present invention will be apparent from the following description, reference being had to the accompanying drawings.

BRIEF DESCRIPTION OF THE DRAWINGS

FIG. 1 is a block diagram of a circuit control.

FIG. 2 is a diagram explanatory of memory banking.

FIG. 3 is a vertical section of a laser printer.

FIG. 4 (*a*) and (*b*) are diagram explanatory of suspended state of the front end of a paper at the position of register rollers.

FIG., 5 (*a*) and (*b*) are diagram explanatory of conditions of composite images.

FIG. 6 through 10 are flow chart showing control procedure.

Figure 11:
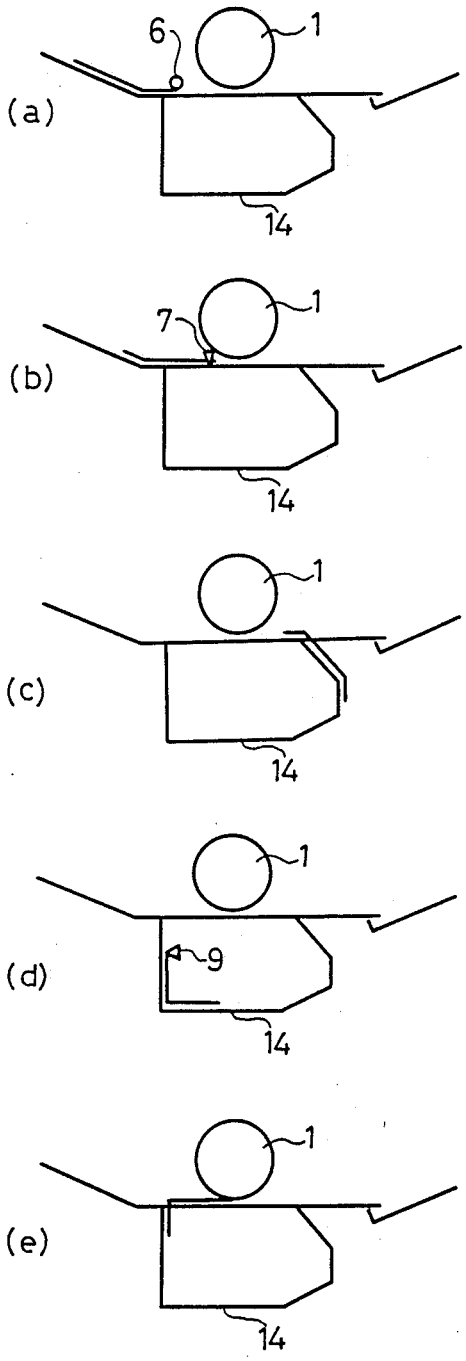

FIG. 11 is an operational diagram.

Figure 12:
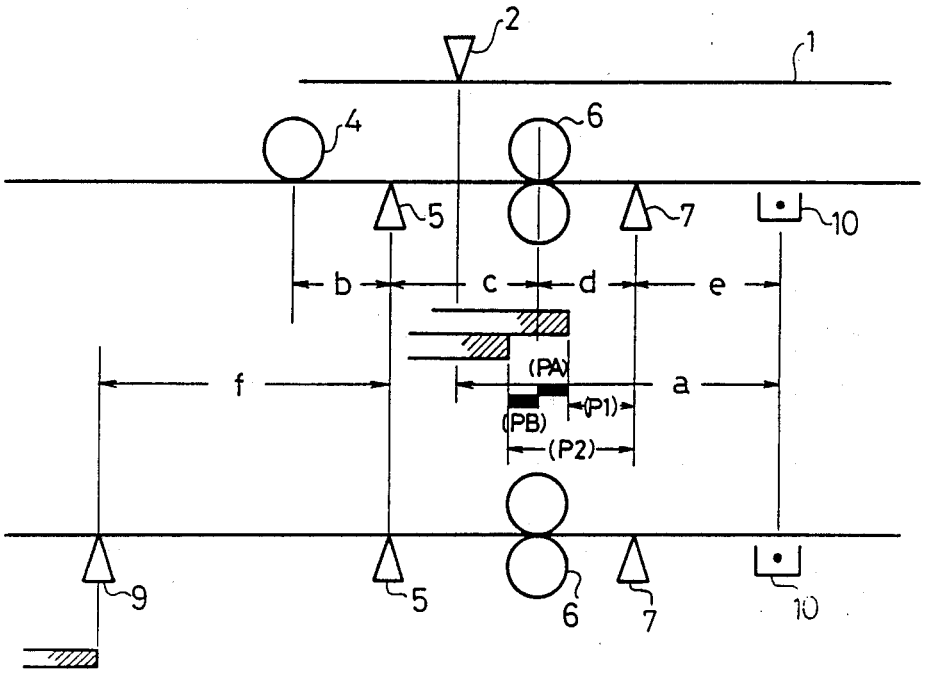

FIG. 12 is a diagram illustrating a relation of setting value between sampling data and exposure on timer.

FIGS. 13 through 16 show the second embodiment of the present invention.

Figure 13:
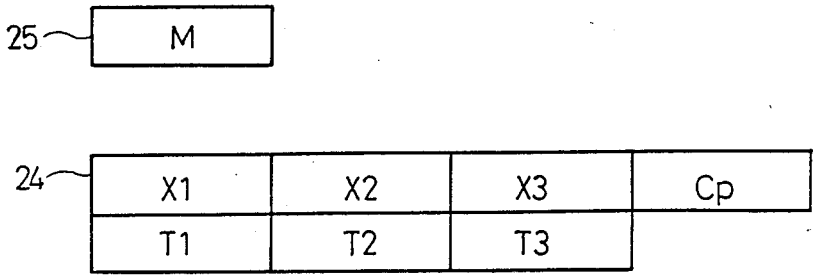

FIG. 13 is a diagram explanatory of memory banking.

Figure 14:
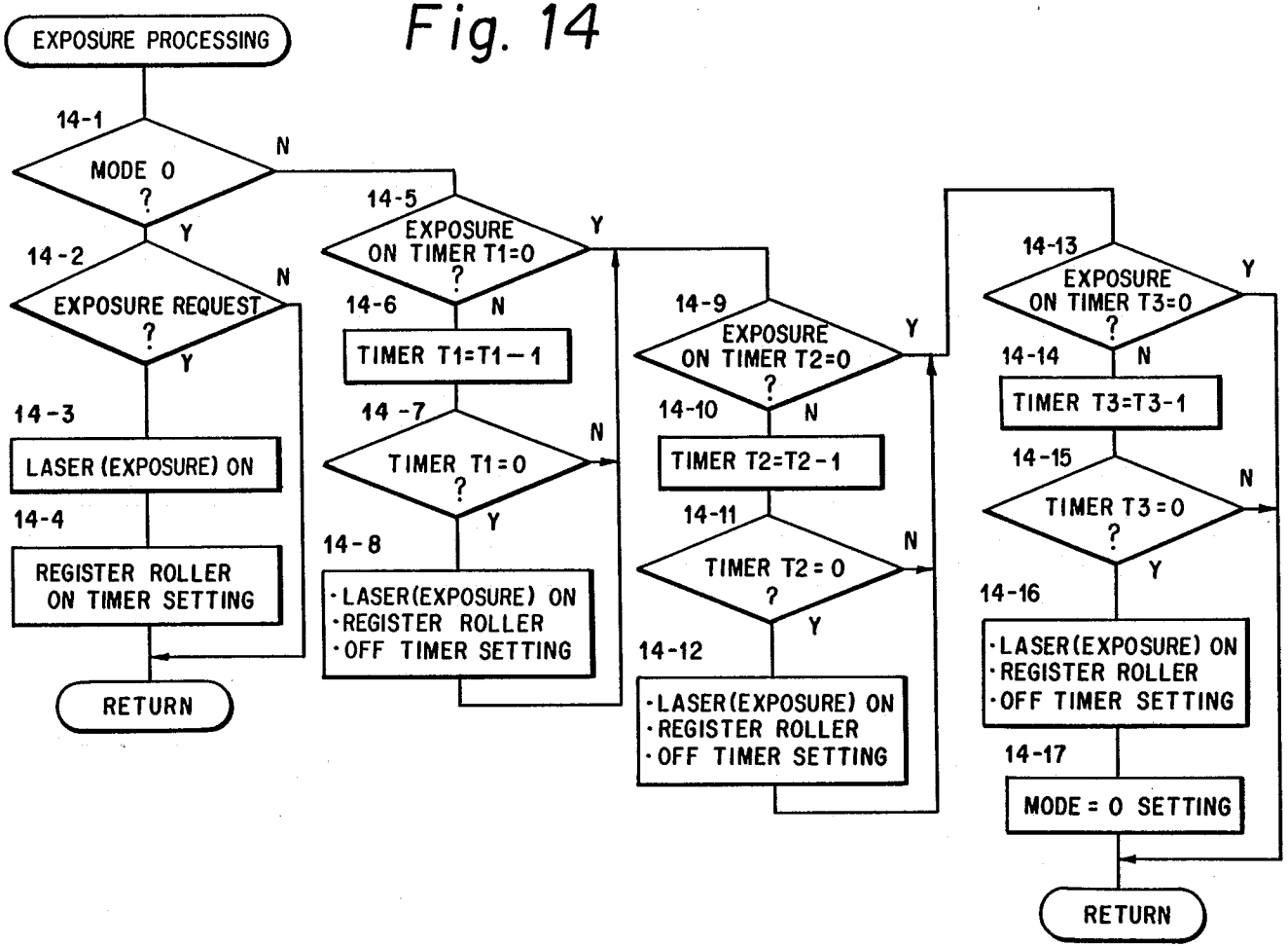
Figure 15A:
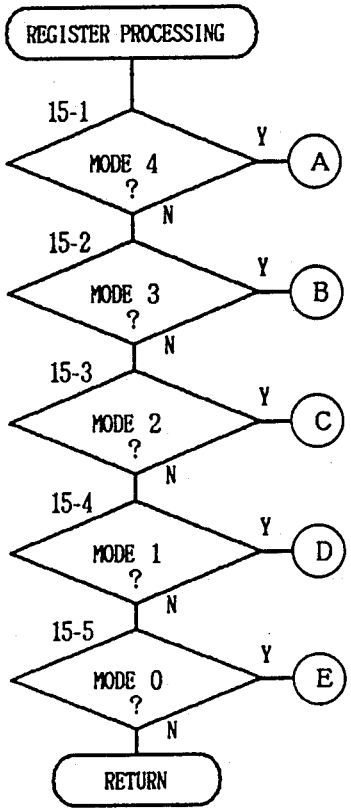
Figure 15B:
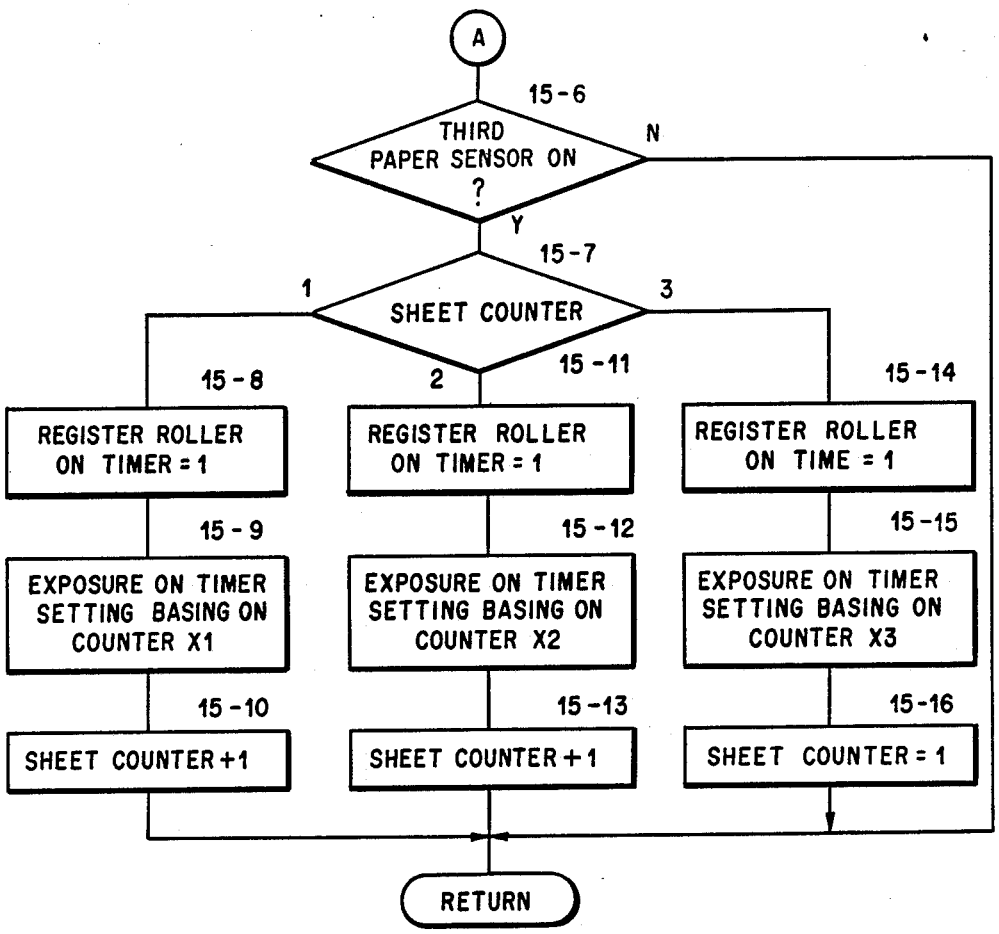
Figure 15F:
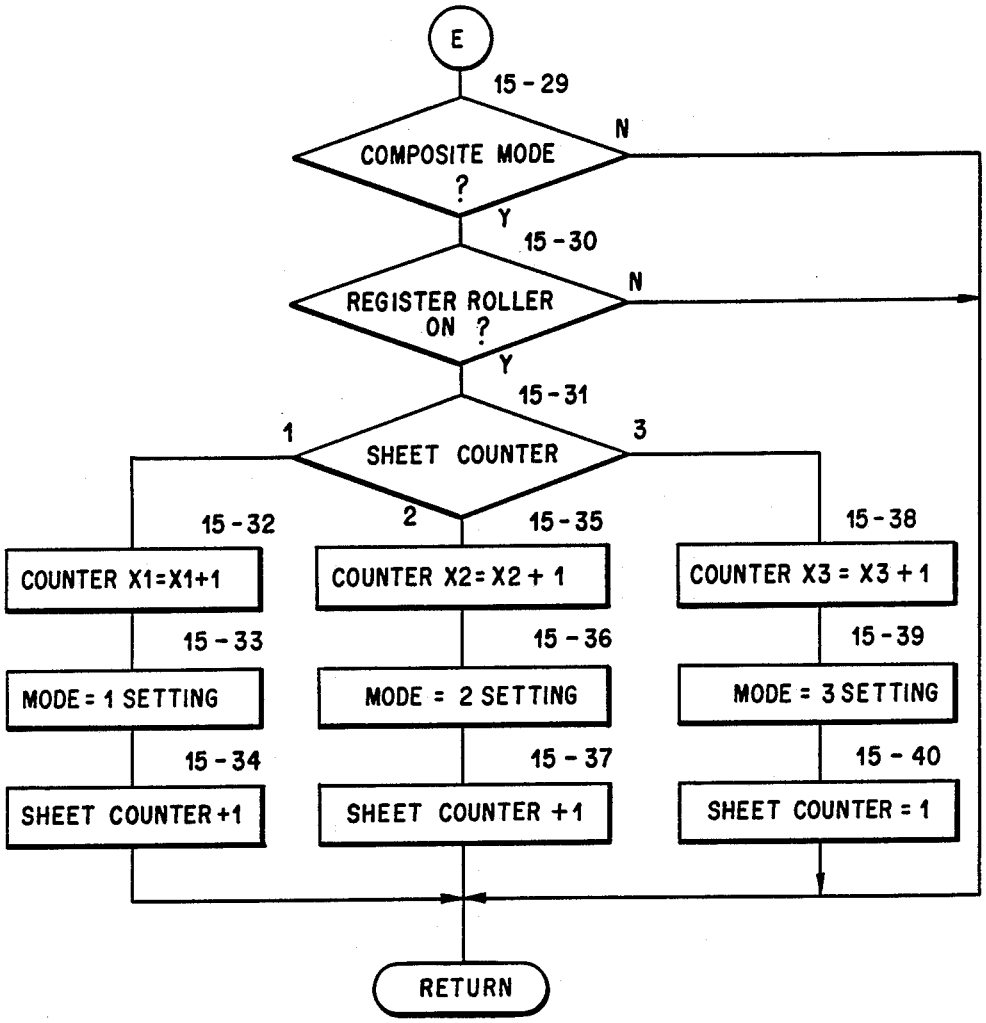

FIG. 14 and 15 are flow charts showing principal control procedure.

Figure 16:
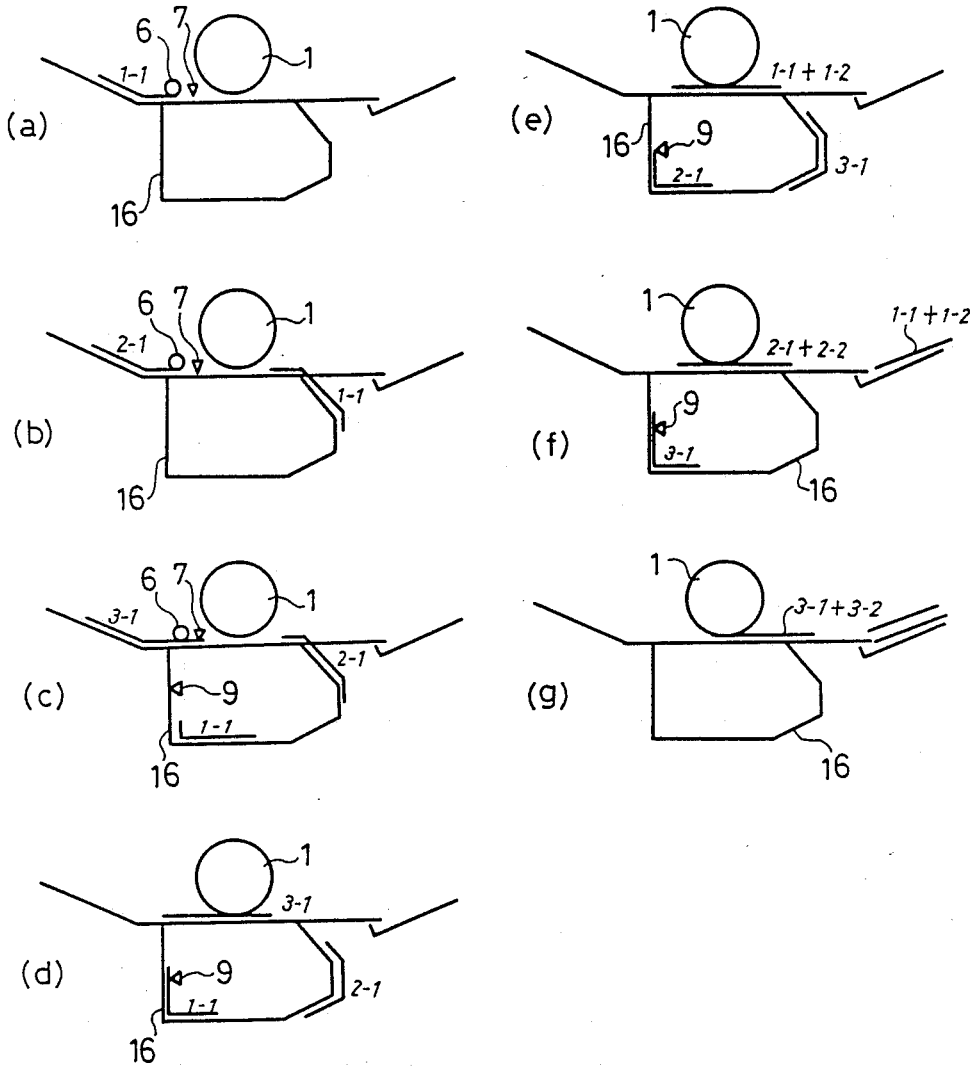

FIG. 16 is an operational diagram.

It is to be noted like parts are designated by like reference numerals for each embodiment and that common diagrams in the second embodiment to that of the first embodiment are omitted.

DETAILED DESCRIPTION OF THE INVENTION

Embodiments of the present invention applied to a laser beam printer will be described below.

FIGS. 1 through 12 show the first embodiment of the present invention.

Figure 3:
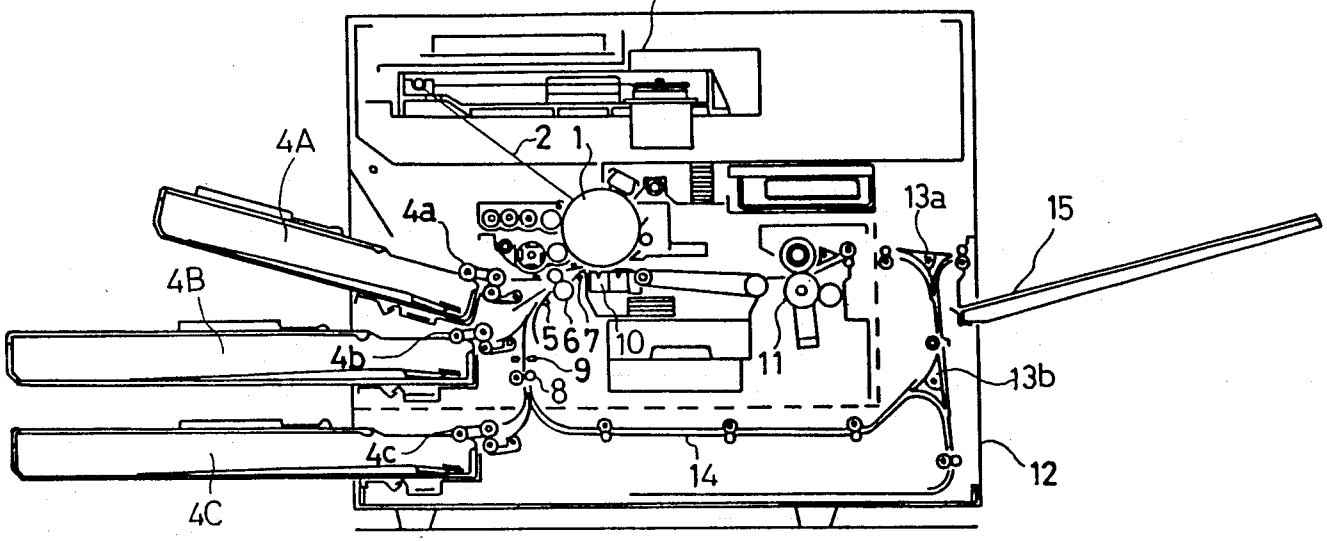
Figure 4:
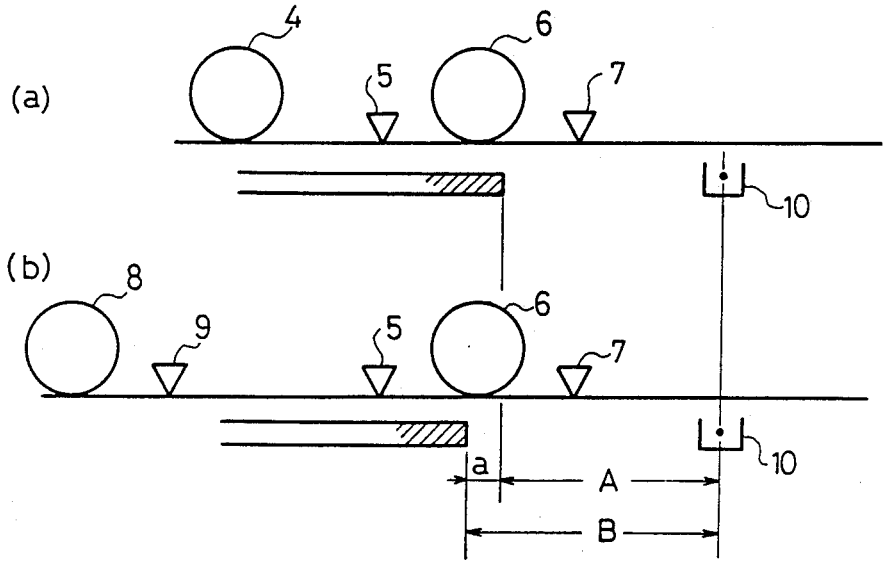
Figure 5:
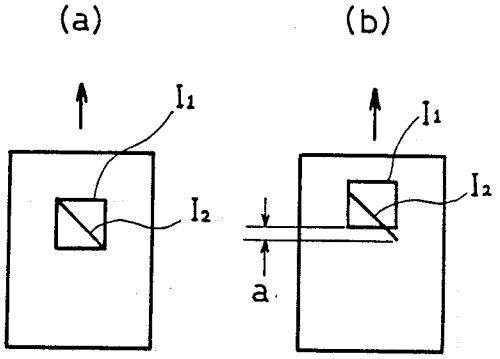

The whole structure of the laser beam printer is shown in FIG. 3 in which designated by numeral 1 is a photoconductive drum on which laser beam 2 is irradiated from an exposure device 3. The laser beam 2 is generated according to an image signal thereby forming an electrostatic latent image onto, the photoconductive drum 1 corresponding to the image signal.

At the left side of the photoconductive drum 1, paper feed sections provided with paper feed rollers 4*a*–4*c* which correspond to upper, middle and lower paper cassettes 4A–4C are disposed.

A paper sheet passed through the paper feed rollers 4*a*–4*c* is fed to transfer/separation chargers 10 via first paper sensor 5, register rollers 6 and second paper sensor 7, and an image on the photoconductive drum 1 is transferred onto the sheet of paper. The paper on which an image is transferred is then transported via fixing section 11 either to a paper discharge tray 15 in case of an ordinary image forming operation or to a paper re-feeding path 14 when composite image formation is required, which is lead by changeover claws 13*a* and 13*b*. The paper in the re-feeding path 14 is carried through paper re-feed rollers 8, third paper sensor 9 and again the register rollers 6, thereafter the second transfer is made for composite image formation.

Figure 1:
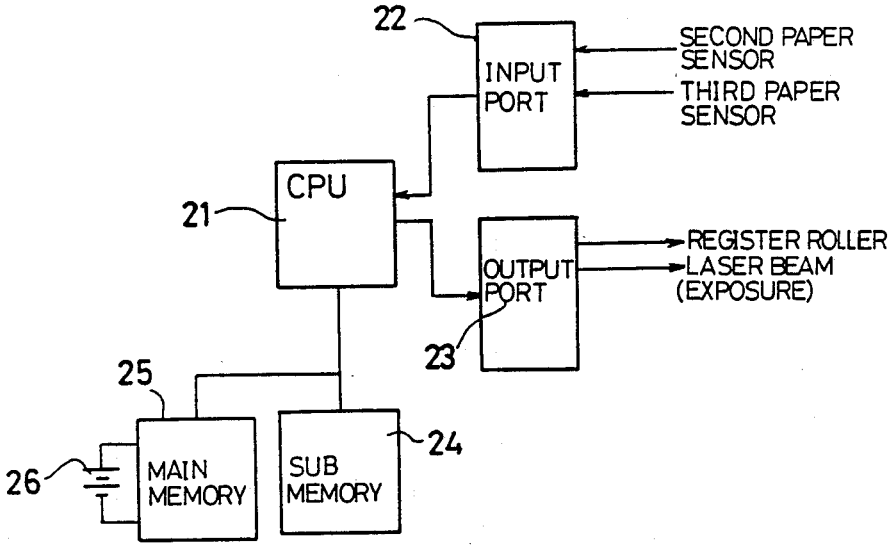
FIGS. 1 through 12 show the first embodiment of the present invention.

A structure of control device will then be described with reference to FIGS. 1 and 2. In FIG. 1, various input port 22 and output port 23 are provided for CPU 21, and various pieces of information are controlled. The CPU is arranged to make direct access to submemory 24 and also to main memory 25.

Figure 2:
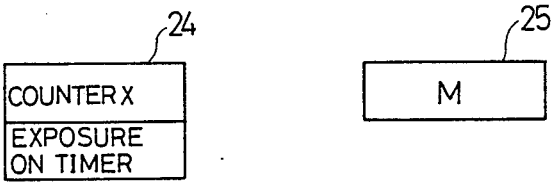

As shown in FIG. 2, in the submemory 24, counter X for storing sampling data taken at the first image formation and an area for timer T for turning on exposure are provided, and in the main memory 25, an area M for storing mode data is prepared for register processing. The main memory 25 is backed up by a battery power 26, and the data stored therein are maintained even if the power is turned off and turned on again.

Figure 6:
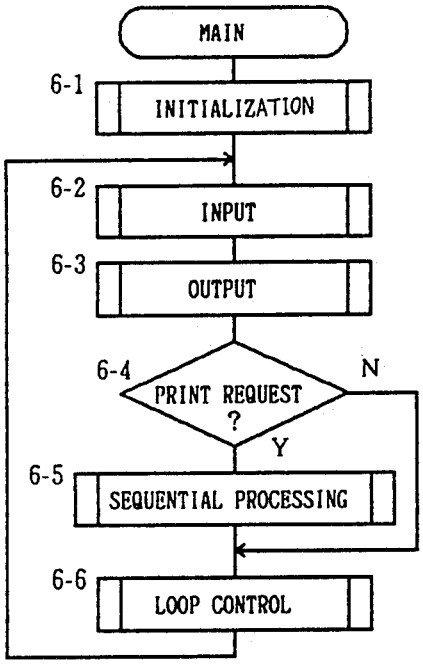
Figure 7:
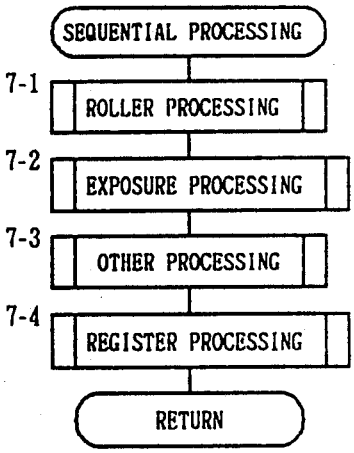

The operation of the above described structure will be described with reference to the flow charts shown in FIGS. 6 through 10. FIG. 6 shows a schematic main routine. To start with, initialization is executed on the items related to CPU (6-1), thereat counter X is cleared and register mode is set to "0" for an initial mode. Thereafter, the program gets into a loop processing in a predetermined time. Input procedure (6-2) and output procedure (6-3) are then executed, and depending on the judgment of print request (6-4), instruction is given either for sequential procedure (6-5) or for bypass procedure. After the first loop procedure is completed through a loop control (6-6), the program returns to input procedure (6-2).

The sequential processing described above is shown in FIG. 7 wherein timing processing (7-1) for turning on and off various rollers, exposure processing!(7-2) and other processing for sensor, etc. (7-3) are executed, and register correction processing (7-4) is further executed.

Figure 8:
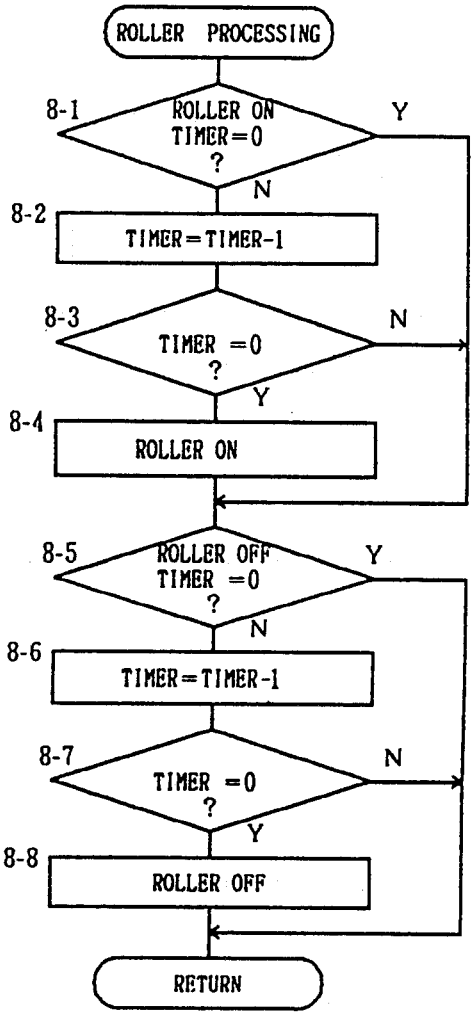

Processing for various rollers will be described referring to FIG. 8. Timing data areas (not shown) provided for each roller make judgment as to whether roller on time and roller off time are "0" or not (8-1) (8-5), and count down is succeeded (8-2)(8-6), then at the time when the roller on time and roller off time became "0" (8-3)(8-7), turning on (8-4) or turning off (8-8) of each roller is executed.

Figure 9:
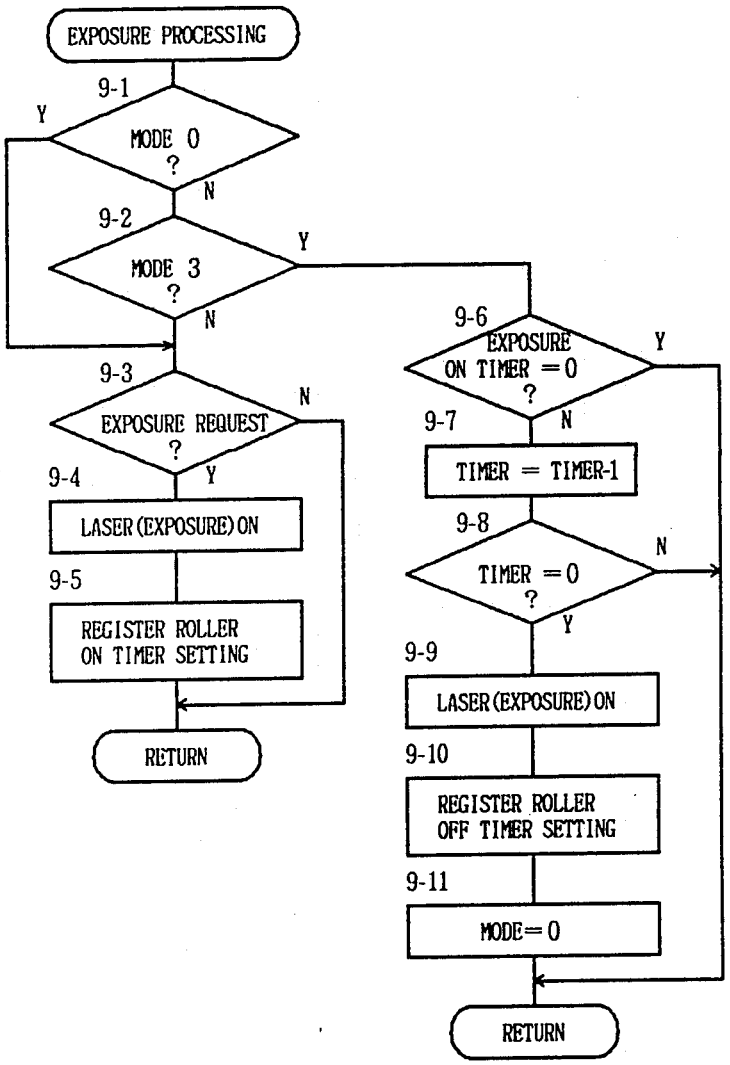

Exposure processing will be described referring to FIG. 9. Judgment is first made on mode (9-1), and when mode is "0", ordinary exposure procedure is executed. In this ordinary exposure processing, judgment is made as to whether exposure request was received or not (9-3), and if received, exposure is turned on (9-4) and at the same time, timer for turning on register rollers is set (9-5).

In the judgment for the mode (9-1), if the judgment is "3", judgment is made as to whether exposure on time is "0" or not, and if the judgment is not "0", subtraction is made on the timer (9-7) and judges whether the time is "0" or not (9-8). If the time is not "0", the program returns as it is. At the time when the timer became "0" in the judgment, exposure is turned on (9-9), and off-timer of the register, roller 6 is set.. (The register rollers 6 are turned on in advance in the register processing). Further, the program returns to mode "0" which means the end of a series of correcting processing. Then, the program returns to the processing for correcting the paper coming out next.

Figure 10:
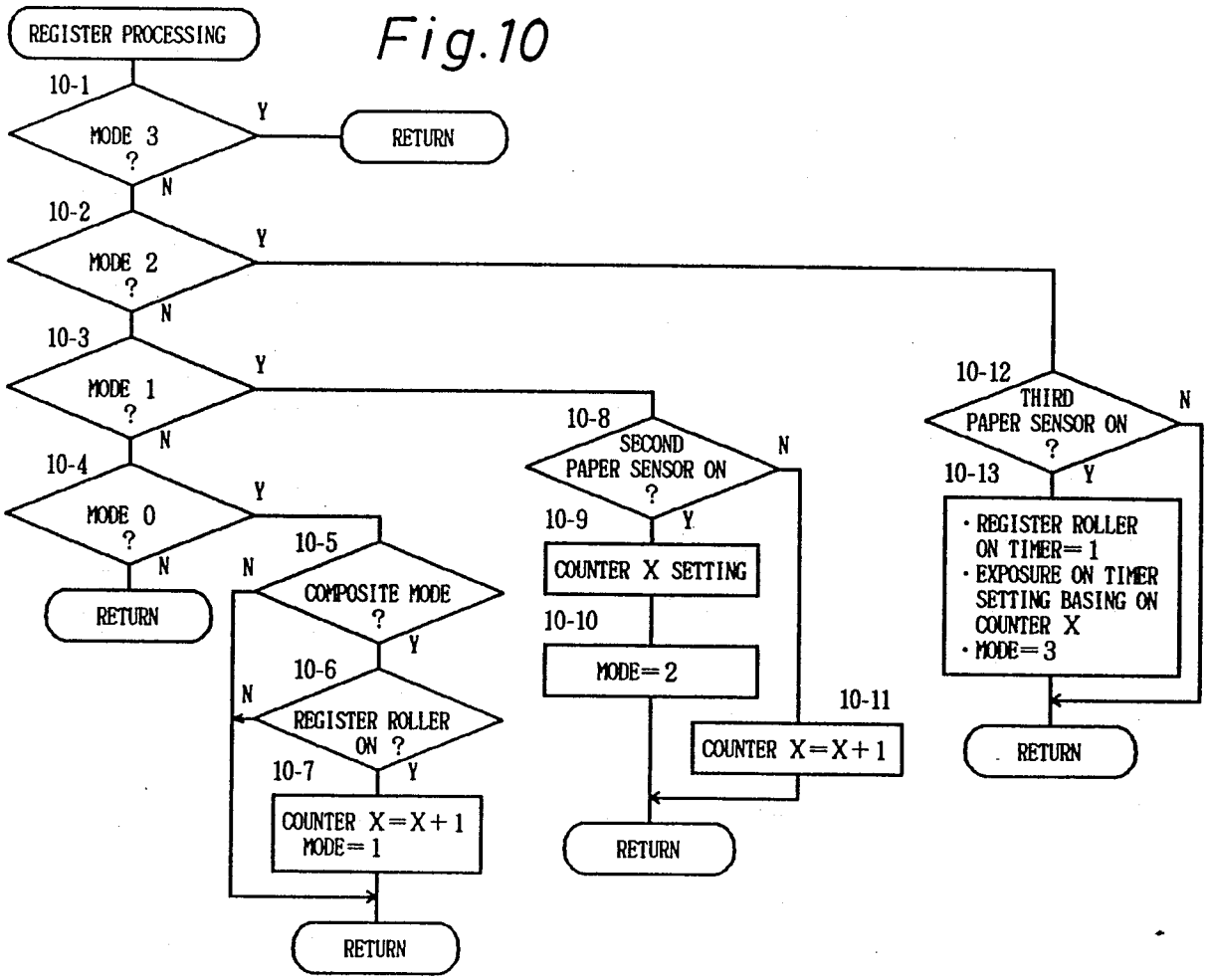

Register processing will now be described referring to FIG. 10. Mode is judged to start with (10-1–10-4). If the mode is judged as "0" at an initial judgment, judgment is made as to whether print request is for composite mode or not (10-5), and if it is for an ordinary mode, the program returns as it is. In case of composite mode, time measurement is made by counter X how long it will take for the front end of paper to reach the second paper sensor 7 from register rollers 6 in the first image forming process by making judgment on an initial register rollers. Accordingly, one is added to counter X and mode is made to "1" (10-7), then the program returns.

Next, judgment is made as to whether second paper sensor 7 is turned on or not (10-8), and addition to counter X is made until the second paper sensor is turned on (10-11). With second paper sensor turning on, addition to counter X is finished (10-9), and the program returns as mode "2". Then, judgment is made as to whether third paper sensor 9 is turned on or not (10-12). In other words, the, timing for second image formation is secured by detecting the leading end of the paper with the third paper sensor without stopping the paper passed through the paper re-feeding path 14 at the position of register rollers.

Register roller on timer is, therefore, set to 1 (10-13) since the register rollers 6 are turned on in advance. Then, the register rollers 6 are turned on within the roller processing program. The timing for turning on exposure for the second image formation is calculated basing on the value of counter X and exposure on timer is set (10-13), with further setting of mode to "3" (10-13). Then, exposure is turned on for the second image formation within the exposure processing, and the program returns without any process in the register processing.

Positional relations of paper sheets in the processing explained above will now be described below with reference to FIG. 11. At (a), counter X starts counting when register rollers 6 are turned on and mode moves from "0" to "1". At (b), time is measured the leading end of paper reaches the position of the second paper sensor 7. In other words, counter X is set when the second paper sensor is turned on and mode moves from "1" to "2". At (c), the paper with first image formed thereon passes through the paper re-feeding path 14. At (d), when the third paper sensor (9) detected the leading end of paper, the timer T for turning on exposure for the second image formation is set basing on the value of counter X and mode "2" moves to "3". At (e), the second image formation is done on the paper, and composite image is discharged.

The relation between the value of counter X which represents sampling data and the value of exposure on timer T will be described referring to FIG. 12. When the system speed is designated as X (mm/sec), the time required for the paper traveling from register rollers 6 to the second paper sensor 7 becomes d/X(sec) theoretically. However, there is a difference in the measured sampling data between the cases when the leading end of paper stopped protruding the position of register rollers 6 (P1) and when it stopped in front of the register rollers (P2), which can be expressed as follows.

$$P1 < d/X < P2$$

Practically, for correcting the timing of turning on exposure for the second image formation, the data of P1 and P2 for d/X and the data of PA or PB(sec) will be required.

$$PA = d/X - P1 \quad PB = P2 - d/X$$

On the other hand, the timing data for the period from the time the third paper sensor, (9) detected the paper to the time exposure is turned on is expressed as:

$$(f+c+d+e-a)/X$$

In case of P1, an image is formed inside the front end of paper since the paper is carried a far in the first image formation, and therefore, the timing for turning on exposure in the second image formation has to be delayed by PA (sec) than the theoretical timing of exposure on time. The timing Tp1 for tuning on exposure will, therefore, be;

$$Tp1 = (f + c + d + e - a)/X + PA$$

$$(f + c + e - a)/X + 2d/X - P1$$

In case of P2, when considered in the same manner, an image is formed more nearer to the leading end of paper since the paper is delayed, and therefore, the timing Tp2 for turning on exposure will be;

$$Tp2 = (f + c + d + e - a)/X - PB$$

$$(f + c + e - a)/X + 2d/X - P2$$

Accordingly, it will be understood that the timing Tp for the second exposure on time can be set by the following equation basing on the sampling data P obtained when the first image formation is made.

$$Tp=(f+c+e+a)/X+2d/X-P$$

A second embodiment of, the present invention will be described with reference to FIGS. 13 through 16. In this embodiment, detection is made on each sheet of paper for its correlative positional error between a paper and an image when the first image formation is made in the composite image forming mode, and paper are successively transported to the transfer section without stopping them at the position of the register rollers on and after second image forming process while setting the exposure on timing on each sheet of paper corresponding to the error detected, which differ from the first embodiment of the present invention.

Accordingly, dislocations of composite images on each sheet of paper can be decreased while forming images on a plurality of paper sheets, and peculiar functional effect is shown that no composite dislocation is occurred even if the quality of paper and paper feeding tray is changed in supplying a plurality of paper sheets.

In this embodiment, the area which is disposed in submemory 24 differs from the first embodiment of the present invention. As illustrated in FIG. 13, the subroutine 24 is provided with three counters X1, X2 and X3 for storing sampling data obtained when first image formation is made on each paper stored in the circulating path, three timers T1, T2 and T3 for turning on exposure corresponding to each copy paper, and an area for sheet counter Cp which counts the number of sheets being transported in the printer while in the main memory 25, an area M is provided for storing mode data for register processing.

The exposure processing subroutine and register processing subroutine which differ from that of the first embodiment of the present invention will now be described with reference to FIGS. 14 and 15.

First, exposure processing will be described referring to FIG. 14. To start with, mode judgment is executed (14-1) and if it is "0", an ordinary exposure processing is carried out. In the ordinary exposure processing, judgment is made whether exposure request was received or not (14-2), and if such request was received, exposure is turned on (14-3) and at the same time, a timer is set for turning on register rollers (14-4). Ordinarily, this processing covers the processing for the first transfer on each sheet of paper.

In the mode judgment (14-1) described above, if "0" is not shown (actually mode is "4" in this case), it means that each copy paper is being transported for the second composite transfer. In this case, exposure on timer T1, T2 and T3 provided for each copy paper make judgment as to whether "0" or not (14-5) (14-9) (14-13), and if "0", the program returns, via bypassing. In other words, exposure on timer in the second image formation for each sheet of paper is set at the time when each sheet of paper reached third paper sensor 9, and before that time, the exposure on timer is "0". The exposure on time T1, T2 and T3 once set are successively subtracted respectively (14-6) (14-10) (14-14), and if the result is "0" after subtraction, exposure is turned on (14-7) (14-11) (14-15). Off timer of register rollers which is put on state previously is also set (14-8) (14-12) (14-16). In this embodiment, three sheets of paper are transported simultaneously, and therefore, if the exposure on timer T3 shows "0" after the subtraction is made, mode is returned to "0" after exposure is turned on (14-17). Image composite is now completed through the first and third image formation for three sheets of paper.

Then, register processing will be described referring to FIG. 15. To start with, mode judgment is made in the flow chart shown in FIG. 15 (*a*) (15-1 - 15-5). At Mode "0", judgment is made whether print request is for composite mode or not as shown in FIG. 15 (*f*) (15-29), and if the request is made for an ordinary mode, not for composite mode, the program returns as it is. In case of composite mode, it is necessary to measure time by counters X1, X2 and X3 for the period between the front end of paper is placed, at the position of register rollers until it reaches the second paper sensor 7 in the first image forming process by making judgment on an initial register rollers. The timing for turning on the register rollers is, therefore, always detected (15-30). After detection is carried out, judgment is made by sheet counter Cp on how many round of paper the register rollers 6 were turned on (15-31), then 1 is added to counter Xl, X2 or X3 upon selection (15-32) (15-35) (15-38), and mode is set "1"-"3" correspondingly (15-33) (15-36) (15-39). The program, thereafter, moves to a mode for detecting the timing for tuning on the second paper sensor 7.

In case the sheet counter Cp is "3", return the sheet counter Cp to "1" (15-40) after making addition to counter X3 and setting the mode to "3", and utilize the data for judgment of setting the next exposure timer. At mode "1", judgment is made whether the second paper sensor 7 is turned on or not as shown in FIG. 15 (e) (15-25) and addition of counter X is made (15-28) until the second paper sensor is turned on. When the second paper sensor is turned on, the addition to counter X is finished (15-26), and the program returns to mode "0" again (15-27) for preparation of the first image forming process of the second copy paper.

At mode "2", the same, process as mode "1" is carried out basically as shown in FIG. 15 (*d*), however, the counter to be added is X2 (15-22)(15-24). Upon the second paper sensor is turned on, the program returns to mode "0" for preparation of the first image forming process of the third copy paper.

At mode "3", the same process as mode "1" and "2" is carried out basically as shown in FIG. 15 (*c*), however, the counter to be added is X3 (15-18)(15-20). Mode is set at "4" (15-19) since the first image forming process of the third copy paper is finished, then move to next step for the second image forming procedure.

At mode "4", judgment is made as to whether the third paper sensor 9 is turned on or not (15-6), and at the same time, judgment is made on the order of paper by reading out the sheet counter Cp (15-7). Register roller on timer is set to 1 since the register rollers 6 are turned on beforehand (15-8)(15-11)(15-14). The register rollers are then turned on instantly within the processing of register rollers. Next, the timing for turning on exposure for the second image formation is calculated basing on the sampling value of counters X1, X2 and X3 previously obtained on each copy paper and exposure on timer T1, T2 and T3 are set (15-9)(15-12)(15-15).

For the first and second, copy paper, addition to the sheet counter is successively made (15-10)(15-13), however, the stored counter Cp is returned to "1" again for the third copy paper. Subroutine of the register processing is completed at this stage. However, the mode is maintained at "4" until the mode becomes "0" within exposure professing (14-17). Judgment for the third paper sensor on is, therefore, made. However, practically no processing is done since there is no paper left.

Referring to FIG. 16, the above procedure will be described from the point of positional correlation of copy paper. In the (a), the leading end of the first paper is positioned at the register rollers 6 and the register rollers are turned on. At this moment, counter X1 starts counting and mode moves from "0" to "1". In the (b), the leading end of the second paper is positioned at the register rollers 6 and counter X2 starts counting and moves from mode "1" to "2". The first sheet of paper had already finished transfer of images and proceeding to the direction of re-feeding. In the (c), the leading end of the third paper passed the position of register rollers 6, and mode moved from "2" to "3" and counter X3 had already started counting. When the leading end of paper reaches the second paper sensor 7, counting of counter X3 is, finished and mode moves from "3" to "4". At this moment, the first paper is already proceeding almost to the position of third paper sensor 9. In the (d), when the leading end of the first paper is detected at the position of the third paper sensor, exposure on timer T2 for the second image formation is setbasing on the value of counter X1. The register roller on timer is set to "1", and the register rollers are turned on in the next loop processing. In the (e), the front end of second paper is detected by the third paper sensor 9 as in the case (d) above, and exposure on timer T2 is set basing on the value of counter X2. At this moment, the second image formation on the first paper is almost finished. In the (f), the front end of third paper is detected by the third paper sensor 9 as in the cases (d) and (e) above, and exposure on timer T3 is set. In the (g), exposure starts for the second image formation on the third paper thereby images are formed and transferred. At this moment, mode is returned to "0", and three sheets of paper with composite images formed thereon are discharged. The relations between the value of counter X which is a sampling data and the value of exposure on timer is the same as described in the first embodiment of the present invention, and therefore, description in this regard will be omitted.

What is claimed is:

1. An image forming apparatus which transfers images formed on a rotating photoconductive drum onto a moving sheet of paper at a transfer position, comprising:

a first paper feeding means for feeding a sheet of paper stored in a stack section to the transfer position;

a paper re-feeding means for re-feeding the sheet of paper transferred to the transfer position again so as to carry on repeated image formations;

a sheet guide for selectively guiding a sheet of paper transferred either to a discharge tray or to the re-feeding means depending on whether image formation is completed;

a second paper feeding means provided in front of the transfer position for adjusting a timing to transport a sheet of paper coming out of the first paper feeding means to the transfer position by stopping the sheet of paper for a predetermined time;

a detecting means for detecting correlative positional error between a sheet of paper and an image at a time of first image formation; and a control means for setting an exposure timing corresponding to an error detected by the detecting means without stopping register rollers by the second paper feeding means when a sheet is fed to the transfer position on second image formation.

2. An image forming apparatus as defined in claim 1, further comprising;

a first memory means having an area for a counter which maintains detected data by the detecting means and for a timer which turns on an exposure;

a second memory means provided with an area for maintaining a mode data for register processing by the second paper feeding means;

wherein the control means performs said control based on the data of the first and second memory means.

3. An image forming apparatus which transfers images formed on a rotating photoconductive drum onto a moving sheet of paper at a transfer position, comprising:

a first paper feeding means for feeding a sheet of paper stored in a stack section to a transfer position;

a paper re-feeding means for re-feeding a sheet of paper transferred to the transfer position again so as to carry on repeated image formation;

a sheet guide for selectively guiding a sheet of paper transferred either to a discharge tray or to a refeeding means depending on whether image formation is completed;

a second paper feeding means provided in front of the transfer position for adjusting a timing to transport a sheet of paper coming out of the first paper feeding means to the transfer position by stopping the sheet of paper for a predetermined time;

a detecting means for detecting correlative positional error between a sheet of paper and an image on each sheet of paper at a time of first image formation; and a control means for setting an exposure timing corresponding to an error detected on each sheet of paper by the detecting means without stopping register rollers by the second paper feeding means when each sheet is fed to the transfer position on and after second image formation.

4. An image forming apparatus as defined in claim 3, further comprising:

a first memory means having an area for a plurality of counters for maintaining a detected data by the detecting means on each sheet of paper to be fed to the re-feeding means, a plurality of timers for turning on an exposure corresponding to each sheet of paper and a counter for counting the number of sheets stored in the second paper feeding means; and a second memory means provided with an area for maintaining a mode data for register processing by the second paper feeding means;

wherein the control means performs said control based on the data of the first and second memory means.

5. An image forming apparatus comprising;

a photoconductive drum rotatable in a predetermined direction;

an image forming means for forming an image onto the photoconductive drum in rotation;

a first paper feeding means for feeding a sheet toward a transfer position where the image on the photoconductive drum is transferred to the sheet;

a paper guide means for defining a sheet path between said first feeding means and said transfer position; and a timing control means, operable in a first adjusting mode and a second adjusting mode, for matching a leading edge of the sheet and a leading edge of the image on the photoconductive drum at the transfer position, said timing control means comprising;

a second paper feeding means, provided upstream of the transfer position in the sheet path, for controlling a release of the sheet from the first paper feeding means by temporarily stopping the sheet for a predetermined time in said first adjusting mode and without stopping the sheet in said second adjusting mode;

a first detecting means, provided at a first position in the sheet path adjacent to said second paper feeding means, for detecting the sheet in the sheet path;

a second detecting means, provided at a second position in the sheet path upstream from said first position, for detecting the sheet in the sheet path;

wherein said timing control means initiates the operation of the image forming means in response to the first detection means in the first adjusting mode and initiates the operation of the image forming means in response to the second detecting means in the second adjusting mode.

6. An image forming apparatus as defined in claim 5, wherein;

said first paper feeding means includes a plurality of paper feeding means and any one of said multiple first feeding means is selectively operated; and said timing control means operates either in one of said first adjusting mode and said second adjusting mode in accordance with the first feeding means.

7. An image forming apparatus which transfers images formed on a rotating photoconductive drum onto a moving sheet of paper at a transfer position, comprising:

a first paper feeding means for feeding a sheet of paper stored in a stack section toward the transfer position;

a paper re-feeding means for re-feeding the sheet of paper fed toward the transfer position repeatedly so as to carry on repeated image formations;

a sheet guide means for selectively guiding a sheet of paper to one of a discharge tray when the image formation is complete and to the re-feeding means when the image formation is incomplete;

a second paper feeding means, provided upstream of the transfer position in a paper path, for controlling release of a sheet of paper from the first paper feeding means and the paper re-feeding means by temporarily stopping the sheet for a predetermined time in a first adjusting mode without stopping the sheet in a second adjusting mode; and a means for selecting the first adjusting mode when said first paper feeding means feeds the sheet of paper toward said second paper feeding means and selecting the second adjusting mode when said paper re-feeding means re-feeds the sheet of paper toward said second paper feeding means.

8. An image forming apparatus which transfers images formed on a rotating photoconductive drum onto a moving sheet of paper at a transfer position, comprising;

a first paper feeding means for feeding a first sheet of paper toward the transfer position;

a second paper feeding means for feeding a second sheet of paper toward the transfer position;

a third paper feeding means provided upstream of the transfer position in a paper path, for controlling release of the sheet of paper from the first paper feeding means and the second paper feeding means by temporarily stopping the sheet of paper for a predetermined time in a first adjusting mode without stopping the sheet of paper in a second adjusting mode; and a timing control means for controlling said third paper feeding means in such a manner that said first sheet of paper is temporarily stopped and thereafter fed again toward the transfer position while said second sheet of paper is fed toward the transfer position without stopping.

9. An image forming apparatus which transfers images formed on a rotating photoconductive drum onto a moving sheet of paper at a transfer position, comprising;

a plurality of first paper feeding means for feeding sheets of paper toward the transfer position;

a switching means for selectively operating any one of said first paper feeding means;

a second paper feeding means, provided upstream of the transfer position in a paper path, for controlling a release of the sheet of paper from the first paper feeding means by temporarily stopping the sheet of paper for a predetermined time in a first adjusting mode without stopping the sheet in a second adjusting mode; and a selecting means for selecting first adjusting mode or a second adjusting mode in accordance with the particular first paper feeding means in operation.

* * * * *